US005551519A

United States Patent [19]

Pach

[11] Patent Number: 5,551,519

[45] Date of Patent: Sep. 3, 1996

[54] DEVICE FOR DRIVING PILES, PREFERABLY POLES, INTO A FOUNDATION

[75] Inventor: Karl Pach, Vienna, Austria

[73] Assignee: ELIN Energieversorgung Gesellschaft m.b.H., Vienna, Austria

[21] Appl. No.: 347,383

[22] PCT Filed: Jun. 8, 1993

[86] PCT No.: PCT/AT93/00097

§ 371 Date: Dec. 5, 1994

§ 102(e) Date: Dec. 5, 1994

[87] PCT Pub. No.: WO93/25765

PCT Pub. Date: Dec. 23, 1993

[30] Foreign Application Priority Data

Jun. 10, 1992 [AT] Austria ..... 1189/92

[51] Int. Cl.[6] ..... E02D 7/16

[52] U.S. Cl. ..... 173/184; 173/28; 173/44; 173/192; 173/194

[58] Field of Search ..... 173/24, 28, 184, 173/190, 192, 193, 194, 42, 44

[56] References Cited

U.S. PATENT DOCUMENTS

| | | | |
|---|---|---|---|
| 2,456,819 | 12/1948 | Dobbs | 173/44 |
| 3,333,646 | 8/1967 | Hoen et al. | 173/194 |
| 3,346,300 | 10/1967 | Grant | 173/192 |
| 3,447,613 | 6/1969 | Lisenby | 173/28 |
| 3,511,320 | 5/1970 | Miller | 173/28 |
| 3,917,005 | 11/1975 | Cannon et al. | 173/28 |
| 4,022,410 | 5/1977 | Ewart et al. | 173/194 |
| 4,050,526 | 9/1977 | Deike . | |
| 4,124,081 | 11/1978 | Deike . | |
| 4,168,751 | 9/1979 | Deike . | |
| 4,703,811 | 11/1987 | Lam . | |
| 4,785,892 | 11/1988 | Luen . | |

FOREIGN PATENT DOCUMENTS

| | | | |
|---|---|---|---|
| 519009 | 11/1981 | Austria . | |
| 387256 | 12/1988 | Austria . | |
| 390294 | 4/1990 | Austria . | |
| 392309 | 10/1990 | European Pat. Off. . | |
| 3615596 | 11/1987 | Germany | E02D 7/20 |
| 1114743 | 9/1984 | U.S.S.R. | E02D 7/06 |
| 1433349 | 4/1976 | United Kingdom | E02D 7/06 |
| 2166780 | 5/1986 | United Kingdom . | |

*Primary Examiner*—Scott A. Smith
*Attorney, Agent, or Firm*—Greenblum & Bernstein P.L.C.

[57] ABSTRACT

Device for driving piles, preferably poles, into a foundation. The device for ramming pole foundations limits idle times between ramming operations and takes the form of a self-propelled rail-road or dual purpose vehicle that can be driven on rails laid on a ballast or over a road surface and the vehicle can swivel over 360° with a top in relation to the undercarriage, with an operation cabin, a counter weight and a hoisting arm being arranged on the noted top, with a turning and tilting unit being provided at a free end of the hoisting arm, with a leader having a rammer mounted in a guiding unit, wherein, in the working position, the leader stands vertically and the top is turned 90° with respect to the direction of the rails and, when the ramming operation is finished, the leader is centrally clamped by the guiding unit and is turned 90° by the turning and tilting unit, with the leader and rammer then being shouldered by the hoisting arm and the device can thus be driven to the next ramming position.

10 Claims, 3 Drawing Sheets

DEVICE FOR DRIVING PILES, PREFERABLY POLES, INTO A FOUNDATION

CROSS REFERENCE TO RELATED APPLICATIONS

This application claims the priority PCT Application No. PCT/AT93/00097, filed Jun. 8, 1993, which in turn claims the priority of Austrian Application No. AT 1189/92, filed Jun. 10, 1992, the disclosures of which are incorporated herein by reference in their entireties.

BACKGROUND OF THE INVENTION

1. Field of the Invention

The invention pertains to a device for ramming a foundation, preferably for a mast, particularly for an aerial or overhead line mast, whereby the foundation is drivable into the soil via a rammer provided on a leader.

2. Discussion of the Background of the Invention and Material Information

Austrian Patent Publication AT-PS 387,256 and AT-PS 390,294 set forth a device for the foundation of a mast which is comprised of four mutually orthogonal steel sheets. This foundation is rammed into the soil with corresponding machines. Ramming in particular has the advantage that no excavation is required. In addition thereto, ramming, for example in rail arrangements does not damage the ballast. During foundation work, via shaking or vibration, the materials, surrounding the anchoring portion, such as sand or broken stone becomes quasi "liquid". A requisite further solidification of the ballast bed is the result.

Up to now, during ramming operations, the guide bar or leader, together with its rammer or drop hammer had to be transported from ramming location to ramming location, after appropriate assembly and disassembly, with a vehicle. Correspondingly long idle times were the result.

It is the task or object of this invention, to produce a device of the previously described type, which limits the idle times between the ramming operations.

This invention solves the noted task or object. The device according to this invention is therein characterized in that the guide bar or leader is attached to a carrier unit via a hoisting arm, wherein one end of the hoisting arm is tiltingly engaged on the carrier unit and carries a turning-tilting unit on its free or other end, which in turn positions the guide bar. By means of this invention it has become possible for the first time, to rationally set or place mast foundations, particularly on already existing overhead transmission lines. Via the turn and tilting abilities of the leader, the leader can thus be so positioned, that on one side, the ramming operation can be performed and, on the other side, the leader with its rammer or drop hammer can be brought into a transport position, in order to cover the distance to the next ramming position, via the carrier unit, in an area having existing overhead lines.

As per a further characteristic of this invention, the carrier unit is comprised of an undercarriage or chassis and of a mounting or top, mounted thereupon, which is pivotable at least 90° and preferably 360°, with a hoisting arm being arranged on the mounting or top. Via the use of such a carrier unit any desired positioning of the guide bar or leader is thus possible.

SUMMARY OF THE INVENTION

In accordance with a further embodiment of this invention, the carrier unit takes the form of a self-propelled rail-road or dual purpose vehicle for use in rails as well as roads, with the vehicle having an operator cabin and a counterweight. Thereby, on one hand, ramming operations can take place on rails, thereby providing the advantage of perfect work positioning, since, for example, a road vehicle cannot advance through a rail bed to a ramming location. On the other hand, the vehicle can be street driven from one building site to another.

As per a special characteristic of this invention, the hoisting is hydraulically tiltable or pivotable, in the vertical plane, via a hydraulic cylinder. This ensures easy positioning of the guide bar or leader, since such hydraulic systems are already so well developed that there are practically no interruptions.

In accordance with a further embodiment of this invention, the turning-tilting unit is comprised of a positioning plate, a rotary table and a guide unit for the guide bar or leader. This simple unit, constructed of solid machine elements permits the practical positioning of the guide bar or leader in any position within a three dimensional space.

As per a further characteristic of this invention, the positioning plate is, on one side, rigidly secured to the rotary table and pivotally journalled or received at the hoisting arm, with the rotary table thus being tiltable.

In accordance with a special embodiment of this invention, the positioning plate includes at least one orthogonal plate, with the longer cathetus of the plate being attached at the rotary table, and the center of gravity with the hoisting arm is located close to the center of the hypotenuse of the plate. This simple mechanical element ensures uninterrupted functionality.

As per a further characteristic of this invention, the plate includes attachment points in the corners of the hypotenuse for the hydraulic tilting actuation thereof, wherein each hydraulic cylinder has its other end coupled to the hoisting arm. Thus, a defined tilting movement becomes possible.

In accordance with a special embodiment of this invention, the rotary table includes a toothed ring and is thus movable via a hydraulic motor, wherein the turning angle of the guide bar or leader is at least 90°. In order to place the guide bar or leader into the transport position this tilting is indispensable.

As per a further characteristic of this invention the guide bar or leader is movable in the guide unit preferably via a hydraulic cylinder. Thereby the guide bar or leader, in the transport position, can be supported in the center of its longitudinal extent.

In accordance with a further embodiment of this invention, the guide bar or leader is comprised of multiple pieces and is preferably hydraulically extensible. Thus the lift or stroke can be increased during ramming.

As per a special characteristic of this invention, the rammer or drop hammer is hydraulically actuated. The avoidance of the usual explosion noises contributes to the environmental compatibility of this device.

The main advantage of this invention lies therein that this device can be utilized with existing rail transmission lines. In addition thereto the device of this invention is thusly constructed that, for example, a parallel second rail is not encumbered. Thus, on this second rail, railway operation can be maintained on an unimpeded manner.

Specifically, this invention pertains to a device for ramming a foundation for a mast, preferably a mast for an aerial or overhead line mast, wherein the foundation is drivable into the soil via the device, the device comprising a rammer, with the rammer being provided on a leader and the leader being provided with a hoisting arm, wherein the hoisting arm is tiltable in a vertical plane and retained on a carrying unit, with the carrying unit being comprised of an undercarriage, the undercarriage having mounted thereupon a turnable top, with one end of the hoisting arm being tiltably arranged on the carrying unit, wherein a turning-tilting unit is arranged on a free end of the hoisting arm, with the turning-tilting unit being comprised of a positioning plate, a rotary table and a guiding unit for the leader, with the turning-tilting unit being adapted for the positioning of the leader in any desired position within a three dimensional space.

In a further embodiment of the device of this invention, the positioning plate is fixedly connected, on one side, with the rotary table and is pivotally journalled at the hoisting arm.

In another embodiment of the device of this invention, the positioning plate includes at least one further plate having the form of an orthogonal triangle, with the further plate having a longer cathetus thereof attached at the rotary table and wherein the center of gravity of the triangle, relative to the hoisting arm, is arranged near the center of the hypotenuse of the triangle.

In a differing embodiment of the device of this invention, the further plate includes attachment points in the corners of the hypotenuse of the triangle, for the hydraulic tilting actuation thereof, a pair of hydraulic cylinders each having one end thereof connected with respective ones of the attachment points and, the hydraulic cylinders each having a respective other end coupled to the hoisting arm.

In yet a further embodiment of the device of this invention, the rotary table includes a toothed ring and a hydraulic motor, with the toothed ring being movable by means of the hydraulic motor, with the pivot angle of the leader being at least 90°.

In still another embodiment of the device of this invention, the rotary table includes a toothed ring and a hydraulic motor, with the toothed ring being movable by means of the hydraulic motor, with the pivot angle of the leader being at least 90°.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components wherein.

DETAILED DESCRIPTION OF THE PREFERRED EMBODIMENTS

Figure 1:
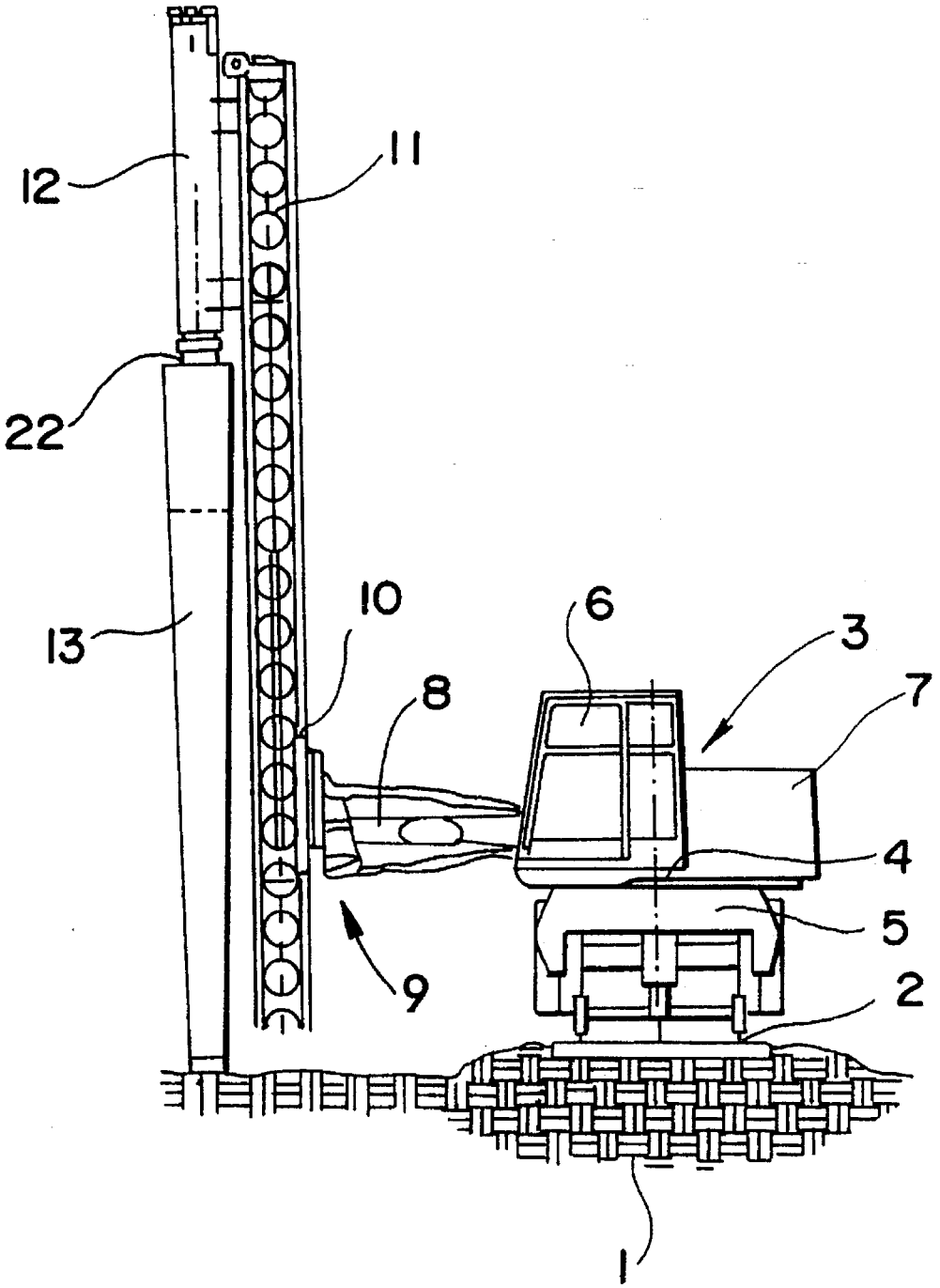
FIG. 1 shows the arrangement in a working position.

In accordance with FIG. 1, rails 2 are positioned on a ballast bed 1 upon which a self-propelled rail-road vehicle 3 can be driven. The rail-road vehicle has a top or mounting 4 that is rotatable 360° relative to its undercarriage 5. Disposed upon top or mounting 4 is an operator cabin 6, a counterweight 7, as well as the hoisting arm 8. The free end of hoisting arm 8 is provided with a turning-tilting unit 9. A guide unit 10 journals or carries leader or guide bar 11 which in turn is provided with rammer or pile driver 12.

In its working position, guide bar or leader 11 is in the vertical position and mounting 4 is turned 90° relative to the directional extent of the rails. The foundation unit or device 13 which is to be rammed or driven into the soil is placed vertically on the soil and the driving cap 22 of rammer or pile driver 12 is placed upon the free upper end of foundation unit 13. The ramming procedure can now be carried out.

Figure 2:
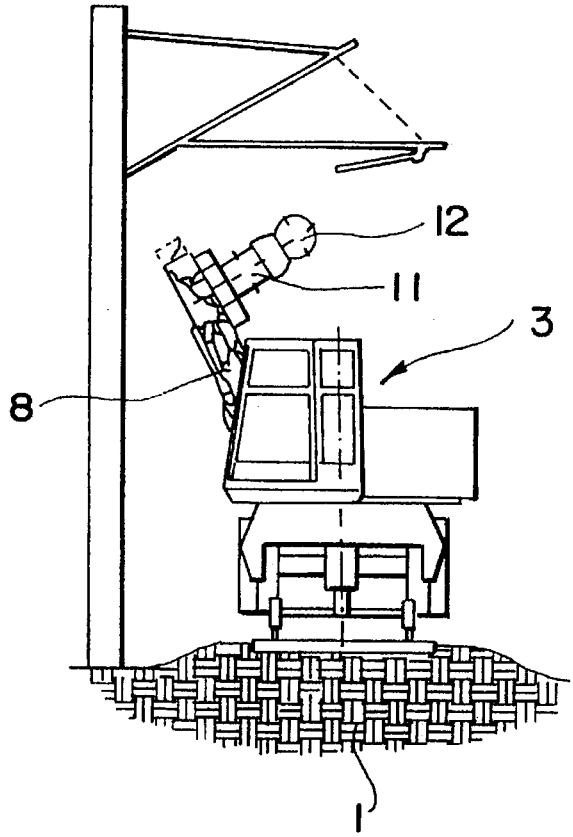
FIG. 2 shows the arrangement during the transporting from a ramming site to ramming site.

Upon completion of the ramming procedure, guide bar or leader 11 is approximately centrally clamped by guide unit 10 and turned 90° by turning-tilting unit 9. Leader 11, together with rammer 12 is then shouldered or carried by hoisting arm 8 (FIG. 2). Transportation to the next ramming site can then be accomplished. At the next ramming site, leader 11 can again be brought to its vertical working position by the tilting of hoisting arm 8 and the positioning of turning-tilting unit 9. The next ramming procedure can now begin.

Figure 3:
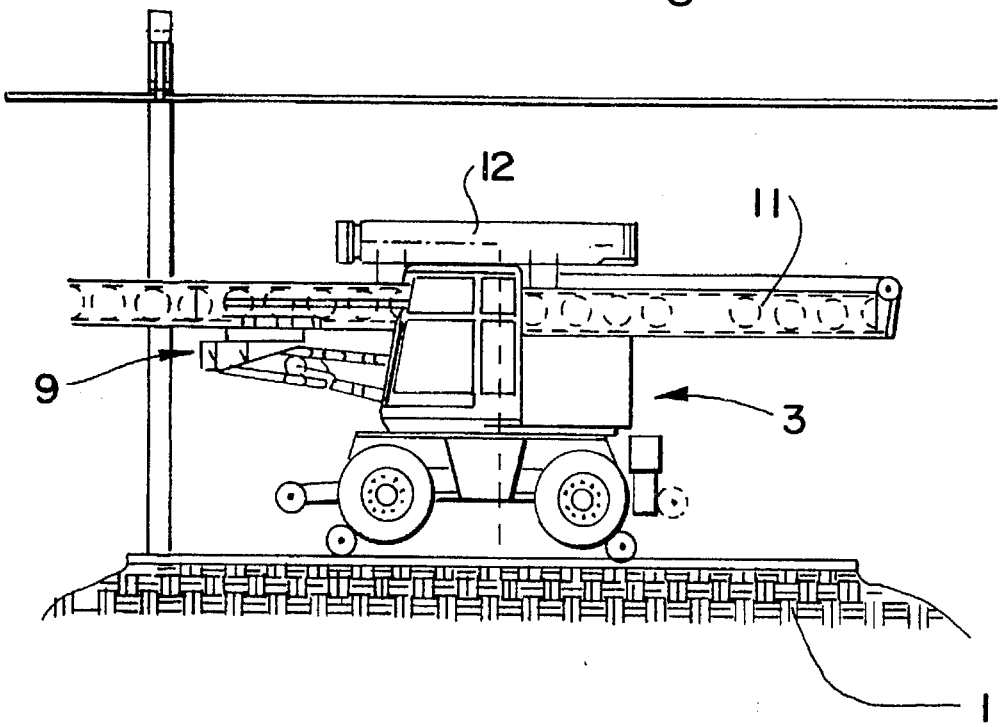
FIG. 3 shows the arrangement during transportation on a rail from one allotment to the next.

If transporting from one building site to a differing building site is required (FIG. 3), mounting or top 4 is turned 90° into its direction of travel and guide bar or leader 11 is horizontally tilted by turning-tilting unit 9 parallel to the directional extent of the rails and lowered by hoisting arm 8. By virtue of its construction of a rail-road or dual purpose vehicle 3, the transportation thereof can also be accomplished on the street or road.

Figure 4:
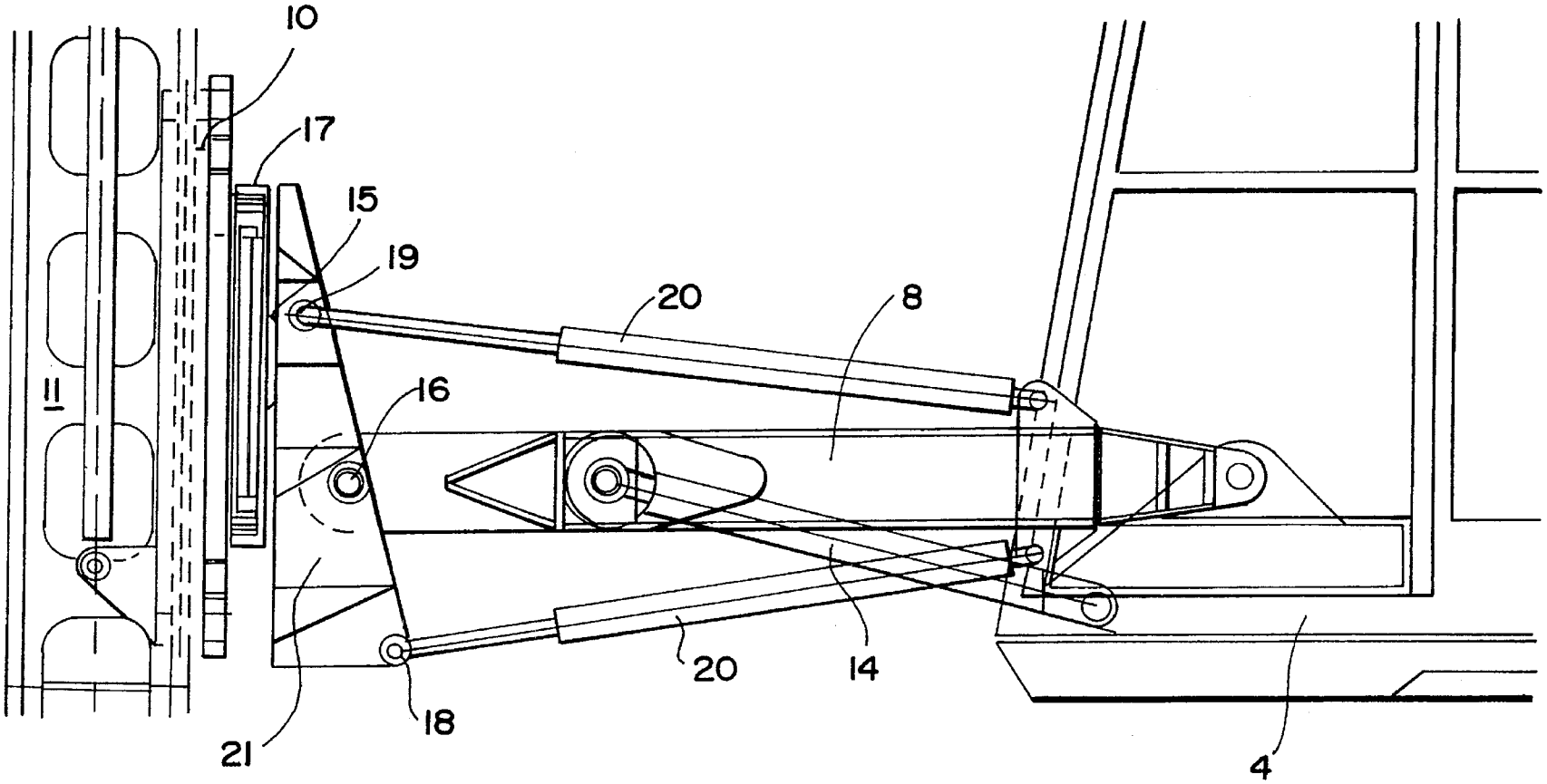
FIG. 4 shows the hoisting arm with the turning-tilting unit.

As per FIG. 4, hoisting arm 8 is tiltably mounted or journalled on mounting or top 4. Hoisting arm 8 is actuatable via at least one, and preferably two, parallelly arranged lifting or raising cylinders 14. Turning-tilting unit 9 is attached on the free end of hoisting arm 8. Turning-tilting unit 9 is comprised of a positioning plate 15, a rotary table 17 and guide unit 10. Positioning plate 15 is pivotally or tiltably attached to hoisting arm 8, whereby its center of gravity 16 is located near the center of the hypotenuse. Positioning plate 15 includes a nearly orthogonal plate 21, with the longer cathetus of plate 21 being attached by positioning plate 15 on rotary table 17. In the corners of the hypotenuse, plate 21 includes attachment points 18, 19, for the hydraulic actuation thereof. Suitable hydraulic cylinders 20 are coupled to the other sides of hoisting arm 8. Rotary table 17 includes a toothed ring and is movable via a non-illustrated hydraulic motor. Guide unit 10 for guide bar or leader 11 is disposed on rotary table 17 on the opposite side of positioning plate 15.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A device for ramming a foundation for a mast, wherein the foundation is drivable into the soil via the device, the device comprising: a rammer, with the rammer being provided on a leader and the leader being provided with a hoisting arm, wherein the hoisting arm is tiltable in a vertical plane and retained on a carrying unit, with the carrying unit being comprised of an undercarriage, the undercarriage having mounted thereupon a turnable top, with one end of the hoisting arm being tiltably arranged on the carrying unit, wherein a turning-tilting unit is arranged on a free end of the hoisting arm, with the turning-tilting unit being comprised of a positioning plate, a rotary table and a guiding unit for the leader, with the turning-tilting unit being adapted for the positioning of the leader in any desired position within a three dimensional space.

2. The device of claim 1 wherein the mast is one of an aerial and overhead line mast.

3. The device of claim 2, wherein the rotary table includes a toothed ring and a hydraulic motor, with the toothed ring being movable by means of the hydraulic motor, with the pivot angle of the leader being at least 90°.

4. The device of claim 1, wherein the positioning plate is fixedly connected, on one side, with the rotary table and is pivotally journalled at the hoisting arm.

5. The device of claim 4, wherein the positioning plate includes at least one further plate having the form of an orthogonal triangle, with the further plate having a longer cathetus thereof attached at the rotary table and wherein the center of gravity of the triangle, relative to the hoisting arm, is arranged near the center of the hypotenuse of the triangle.

6. The device of claim 5, wherein the further plate includes attachment points in the corners of the hypotenuse of the triangle, for the hydraulic tilting actuation thereof, a pair of hydraulic cylinders each having one end thereof connected with respective ones of the attachment points and, the hydraulic cylinders each having a respective other end coupled to the hoisting arm.

7. The device of claim 6, wherein the rotary table includes a toothed ring and a hydraulic motor, with the toothed ring being movable by means of the hydraulic motor, with the pivot angle of the leader being at least 90°.

8. The device of claim 5, wherein the rotary table includes a toothed ring and a hydraulic motor, with the toothed ring being movable by means of the hydraulic motor, with the pivot angle of the leader being at least 90°.

9. The device of claim 4, wherein the rotary table includes a toothed ring and a hydraulic motor, with the toothed ring being movable by means of the hydraulic motor, with the pivot angle of the leader being at least 90°.

10. The device of claim 1, wherein the rotary table includes a toothed ring and a hydraulic motor, with the toothed ring being movable by means of the hydraulic motor, with the pivot angle of the leader being at least 90°.

* * * * *